United States Patent [19]

Dettling et al.

[11] 3,979,052

[45] Sept. 7, 1976

[54] HIGH SECURITY LOCK

[75] Inventors: Joseph R. Dettling, Santa Clara; John P. Barry, Woodland Hills, both of Calif.

[73] Assignee: United Technologies Corporation, East Hartford, Conn.

[22] Filed: May 6, 1974

[21] Appl. No.: 467,420

Related U.S. Application Data

[60] Division of Ser. No. 464,013, April 25, 1974, Pat. No. 3,873,892, which is a continuation of Ser. No. 248,196, April 27, 1972, abandoned.

[52] U.S. Cl. ..... 232/43.1; 232/7; 232/57

[51] Int. Cl.[2] ..... B65D 91/00

[58] Field of Search ..... 232/7, 15, 16, 57, 57.5, 232/1 R; 70/413, 275–278; 292/DIG. 66

[56] References Cited

UNITED STATES PATENTS

| | | | |
|---|---|---|---|
| 1,470,747 | 10/1923 | Juley | 232/57.5 |
| 1,876,894 | 9/1932 | Fitzgerald | 292/DIG. 66 |
| 2,288,222 | 6/1942 | Bockstein | 232/57 |
| 2,566,017 | 8/1951 | Cooley | 70/413 |
| 2,676,689 | 4/1954 | Galloway | 232/1 R |
| 3,116,013 | 12/1963 | Eno | 232/57.5 |
| 3,118,597 | 1/1964 | White | 232/16 X |
| 3,215,903 | 11/1965 | Barney | 70/413 |
| 3,332,713 | 7/1967 | DeClaire | 70/277 |
| 3,571,544 | 3/1971 | Sheehan | 70/413 |
| 3,718,922 | 2/1973 | Williams et al. | 232/16 |
| 3,779,052 | 12/1973 | Deitch | 70/276 |
| 3,873,892 | 3/1975 | Dettling et al. | 70/276 |

*Primary Examiner*—Ramon S. Britts
*Assistant Examiner*—Darrell Marquette
*Attorney, Agent, or Firm*—Steven F. Stone

[57] ABSTRACT

A keyhole-less magnetically actuated lock, the key having magnets borne on concentric rings rotatable by a dial, the lock having magnetically responsive switches (for example, reed switches) within the lock actuatable by the key, some of the switches providing a series GO function and some providing a parallel NOGO function. In one form, the GO function powers an electric motor within the lock to withdraw the lock bolts, and in another form the actuator is a thermo electric device. Several NOGO techniques are shown, including a toggled circuit breaker and a bucking coil in the motor. A circuit is shown for inverting the GO and NOGO functions to change the combination of the lock, and one embodiment shows placement of two magnets on one ring in the key to render the key unique. Another embodiment shows use of a covert grid of locator marks to direct correct placement of the key against the lock. The lock is shown associated with two forms of coin receptors for coin operated machines, one having a pull-out drawer and the other having a hopper and a delivery chute for collection of the coins. In one form shown, the combination is advanced incrementally each time the lock is opened, the key being reset each time to compensate, and in another form the magnets of the key and the switches of the lock rotate in synchronism as the lock opens. A form is also shown in which the lock is powered from the key.

4 Claims, 21 Drawing Figures

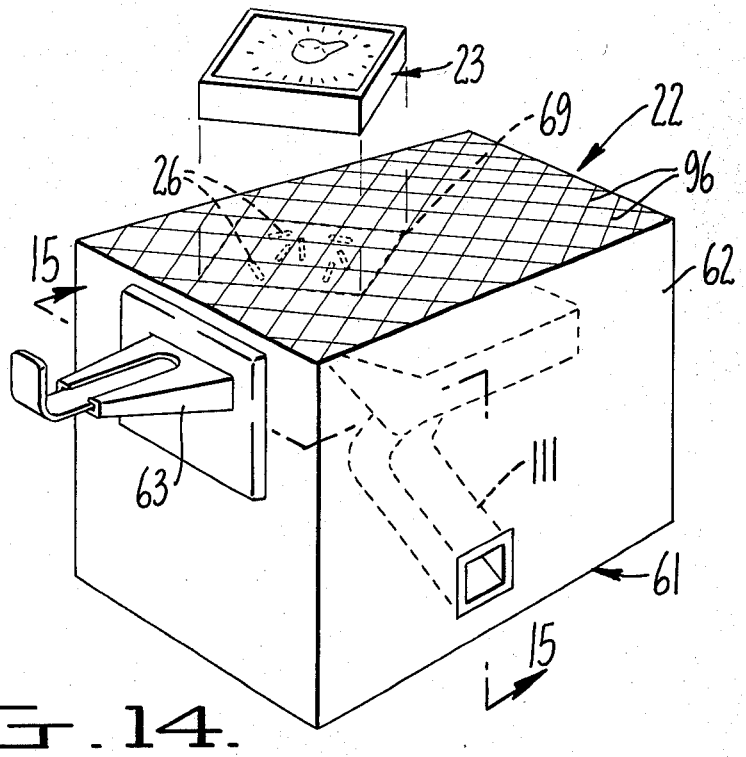
FIG. 14.
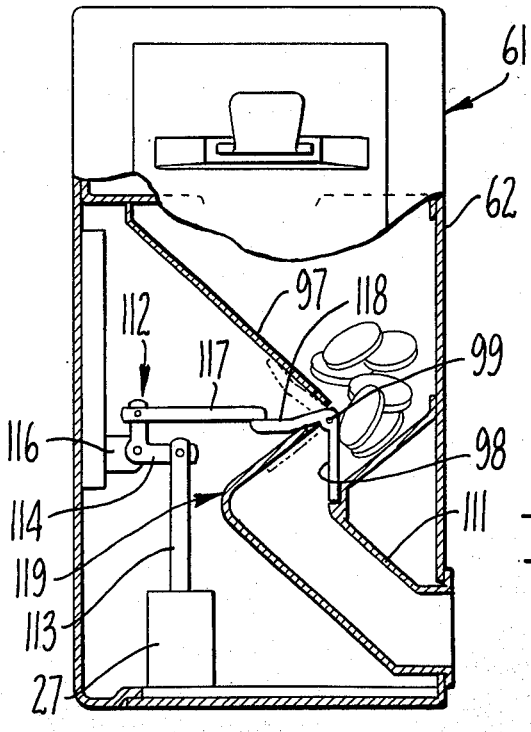
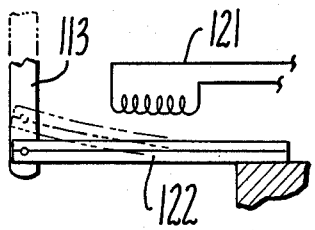
FIG. 21.
FIG. 15.

HIGH SECURITY LOCK

CROSS REFERENCE TO RELATED APPLICATIONS

This Application is a division of U.S. application, Ser. No. 464,013, filed Apr. 25, 1974 for High Security Lock, now U.S. Pat. No. 3,873,892, which application is a continuation of U.S. application Ser. No. 248,196, filed Apr. 27, 1972, now abandoned.

BACKGROUND OF THE INVENTION

The present invention relates to a High Security Lock, and more particularly to a magnetically actuated lock having no penetration of the key into the lock.

Such high security locks are currently in demand in the coin-operated machine industry, althrough this is by no means the limit of their usefulness. However, the coin-op industry is faced with special problems from the intensity of pilferage. In an effort to render the locks used more pick-proof, sophisticated pin-tumbler locks have been developed having axial tumblers disposed in a ring shape, limited access apertures and other features intended to impede picking. None of these efforts have succeeded in eliminating the keyhole, the focal point of picking attempts. While forcing of the coin enclosures is also a problem, it has been estimated that 90% of the theft losses in the coin-op laundromat field are from lock picking and keying, rather than forcing. A pick-proof lock would thus be a considerable advance in theft prevention.

A number of previous efforts in the direction of magnetically actuated locks have resulted in cumbersome and expensive devices which produced little in the way of added security and sophistication, and were poorly adapted to inexpensive production in volume. Such locks often offered little advantage over a well made pin tumbler lock so far as picking and forcing were concerned. One group of prior art magnetic locks are those wherein a small number of locks are intended to be operated by a large number of card-sized magnetized keys. Such locks require a slot for penetration of the card into the lock body, thus laying the lock open to various attacks through the slot.

Prior locks also offered little or no security against the problem present by a stolen key as no action was required by the operator beyond insertion of the correct key into the lock. Most such locks also had no penalty apparatus to discourage tampering, so that they could ultimately be defeated by a person having adequate time to apply to the tampering effort. In most such locks, the correct location for application of the key to the lock is obvious, as there is a keyhole or slot.

SUMMARY OF THE INVENTION

The locking device of the present invention presents no keyhole or slot to the would-be thief. Instead, a key device having rotatable positionable magnets within it is brought up against the lock portion. Within the lock portion are a group of magnetically responsive switches such as reed switches actuatable by the magnetic fields of the magnets in the key.

Some of the switches in the lock portion are in series with the power supply to an electric actuator which retracts the lock bolts to open the lock, and others are in the line of supply of power to a NOGO device which blocks the actuator. The NOGO devices either interrupt the supply of power to the actuator, or electromagnetically cancel its action.

Since the present locking device is intended generally for systems having a relatively large number of locks operated by a relatively small number of keys, it has been found to be advantageous to transfer some of the sophistication from the lock portion of the key portion of the device. The key portion of the device has its magnets positionable by a dial device to gain the effect of a combination lock, but it can nonetheless be made unique to a particular series of locks.

The NOGO device penalizes tampering by blocking actuation if a broad area field is applied to the lock, and its action may be made to lock out after a tampering effort, so that even the correctly positioned magnets will not actuate the lock until the NOGO device is reset. Resetting may be made through another lock device. Since the lock of the present device requires neither keyhole nor slot, further sophistication may be introduced by making the proper location for positioning of the key on the lock non-obvious, thus in effect adding another element to the correct opening combination. The lockout on the NOGO is particularly useful in this instance, as it prevents sweeping of the key over the lock from being effective.

Accordingly, it is a principal object of the present invention to provide a locking device of the character described which is keyhole-less, pickproof and jimmy-resistant.

It is a further principal object of the present invention to provide a locking device of the character described which cannot be defeated by application of a broad or swept magnetic field.

Another principal object of the present invention is to provide a locking device of the character described which has a great number of possible combinations and can at the same time be master-keyable and have a key with a combination unique to its series, inoperable regardless of setting on locks of another series.

Yet a further object of the present invention is to provide a locking device of the character described which penalizes tampering.

A still further object of the present invention is to provide a locking device of the character described which is capable of automatic periodic combination changing.

Yet another object of the present invention is to provide a locking device of the charater described in which the location for application of the key to the lock is a covert element of the combination.

Further objects and advantages of the present invention will become apparent as the specification progresses, and the new and useful features thereof will be fully defined in the claims attached hereto.

BRIEF DESCRIPTION OF THE DRAWINGS

The preferred form of the present invention is illustrated in the accompanying drawings, forming a part of this specification, in which:

FIG. 14 is a perspective view of another embodiment of the locking device of the present invention;

FIG. 15 is partly cross-sectional front elevation on an enlarged scale with parts broken away of the embodiment of FIG. 14, taken approximately along the plane of lines 15—15 of FIG. 14;

FIG. 21 is a schematic view of one form of lock actuator applicable to the embodiment of FIG. 15.

Figure 1:
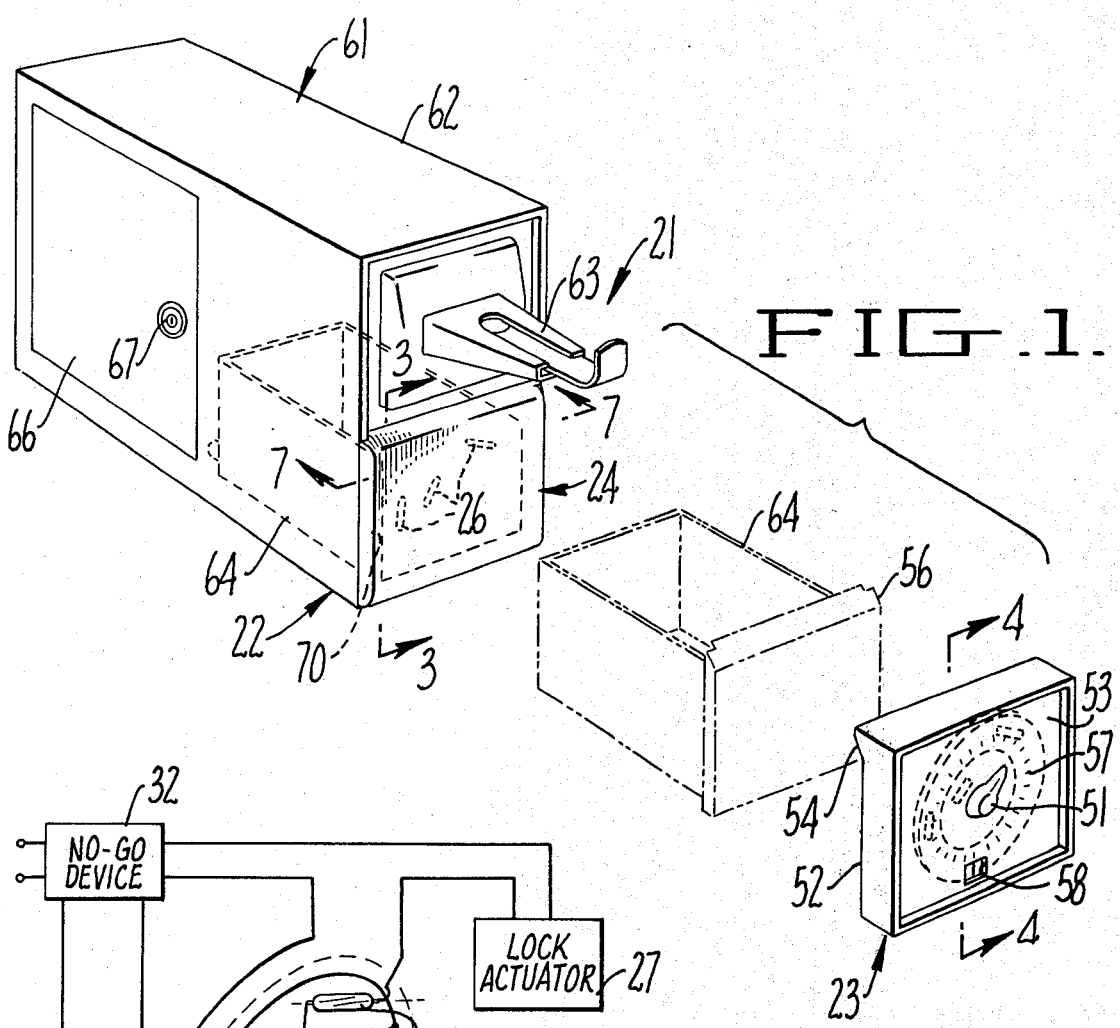
FIG. 1 is an exploded perspective view of the locking device of the present invention in one application, showing the drawer after removal in phantom.

While only the preferred forms of the present invention have been shown, it should be understood that various changes or modifications may be made within the scope of the claims attached hereto.

DESCRIPTION OF THE PREFERRED EMBODIMENTS

Referring to the drawings in detail, it will be seen that the locking device 21 of the present invention includes a lock portion 22 and a key portion 23 for unlocking the lock portion 22. A barrier generally indicated at 24 is interposed between the lock portion 22 and the key portion 23 so that there is no physical penetration of the key portion 23 into the lock portion 22, such as through a keyhole. A number of magnetically responsive switches such as reed switches 26, are arrayed in a pattern within the lock portion 22, and some of the switches 26 are connected in series to control the supply of power to an electromotive device 27 which operates as the lock actuator to open the lock portion 22.

The key portion 23 includes an array of magnets 28 which are positionable to correspond to the pattern of the switches 26. To unlock the lock portion 22, the key portion 23 is operated to correctly position the magnets 28 and then brought into juxtaposition with the barrier 24, which is made of magnetically permeable material. The magnet field of the magnets 28 penetrates the barrier 24 to actuate certain desired ones of the magnetic reed switches 26 to supply power to the electromotive device 27, which then operates to open the lock portion 22.

While certain of the switches 26 are connected in a series circuit identified at 29, others of the switches 26 are connected in a parallel circuit 31 which supplies power to an electrically actuated device 32 within the lock portion 22 which operates to perform the NOGO function by blocking the action of the electromotive device 27. Since the switches 26 in the circuit 31 are connected in parallel relationship to each other, closure of any one of those switches will supply electric power to the electrically actuated NOGO device 32.

Figure 12:
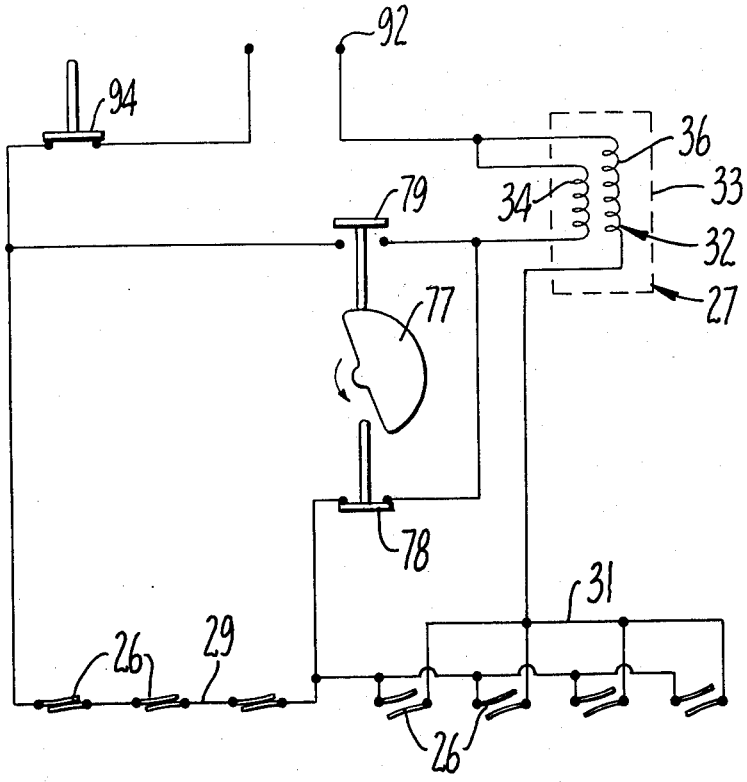
FIG. 12 is a schematic diagram of the electrical circuit of one embodiment of the present invention.

The electrically actuated NOGO device 32 may take a number of different forms. Two such forms are shown schematically in FIGS. 12 and 13. In FIG. 12 the electromotive device 27 which actuates the lock is an electric motor 33 having a conventional driving winding 34. In this embodiment the electric motor 33 is equipped with an additional winding 36 which is so wound and disposed within the motor 33 that it produces a field which cancels the field of the conventional driving winding 34 and prevents operation of the motor 33. This bucking winding 36 constitutes the electrically actuated NOGO device 32 in this form of the invention. It may be seen from the diagram of FIG. 12 then, that closure of all of the switches 26 in the series circuit 29 is necessary to supply electric power to the driving coil 34 of the motor 33, while closure of any of the switches 26 in the parallel circuit 31 will supply power to the bucking coil 36. The bucking coil 36 will act as a NOGO device to prevent actuations of 33 despite the supply of power to the driving coil 34.

Figure 13:
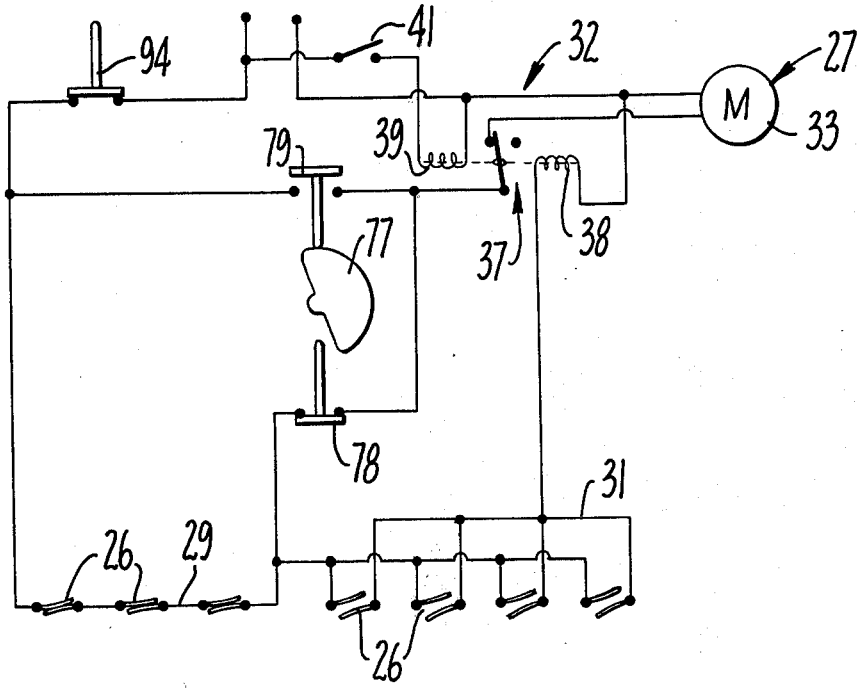
FIG. 13 is a schematic diagram of the electrical circuit of another embodiment of the present invention.

In the circuit of FIG. 13, the NOGO device 32 is a circuit breaker 37 having a trip coil 38. The circuit breaker 37 is arranged with its switch contacts in series within the line of supply of electric power to the electromotive device or lock actuator 27 so that when it is tripped the supply of power to the actuator 27 is interrupted. Closure of any of the switches 26 in the parallel circuit 31 power the trip coil 38 to trip the circuit breaker 37 to its off state and interrupt the supply of electric power, thus blocking the operation of the electromotive device 27.

The circuit breaker 37 could be as simple as a normally closed relay, so that when no circuit was established through the parallel circuit 31 to the trip coil 38 the circuit breaker 37 would pass power from the series circuit 29 to the motor 27. However, as here shown, the circuit breaker 37 is of the toggle action type which remains in its tripped state until electrically or manually reset. For this purpose, the circuit breaker 37 is equipped with a reset coil 39 and reset switch 41 which may be made accessible through some other secured portion of the lock portion 22.

The toggle action of the circuit breaker 37 operates to penalize tampering with the locking device 21, by locking the circuit into a NOGO state when any of the switches 26 in a parallel circuit 31 are closed despite any discontinuance of the tampering and reopening of the switches 26 in the circuit 31. Meddling with the locking device 21 will thus cause it to refuse to open for anyone until it is reset by the reset coil 39 and the reset switch 41. While the reset function is here shown as being accomplished electrically, it may also be accomplished manually as by moving the switch handle of a circuit breaker back to its normal position.

Within the key portion 23, the magnets 28 are carried on a number of rotatable elements 42 which are shown here as ratchet wheels. The rotatable elements 42 are illustrated in a concentric relation and are equipped with sloping ratchet teeth 43 at their peripheries. The ratchet teeth 43 are engaged by a pair of pawls 44 and 46, with the pawl 44 being attached to the inner periphery of the outer ratchet wheel 42 and engaging the inner ratchet wheel 42, while the pawl 46 is attached to the case of the key 23 and engages the outer periphery of the outer ratchet wheel 42. The inner ratchet wheel 47 is attached through a shaft schematically shown as 49 to a knob 51 by which it may be rotated.

Figure 2:
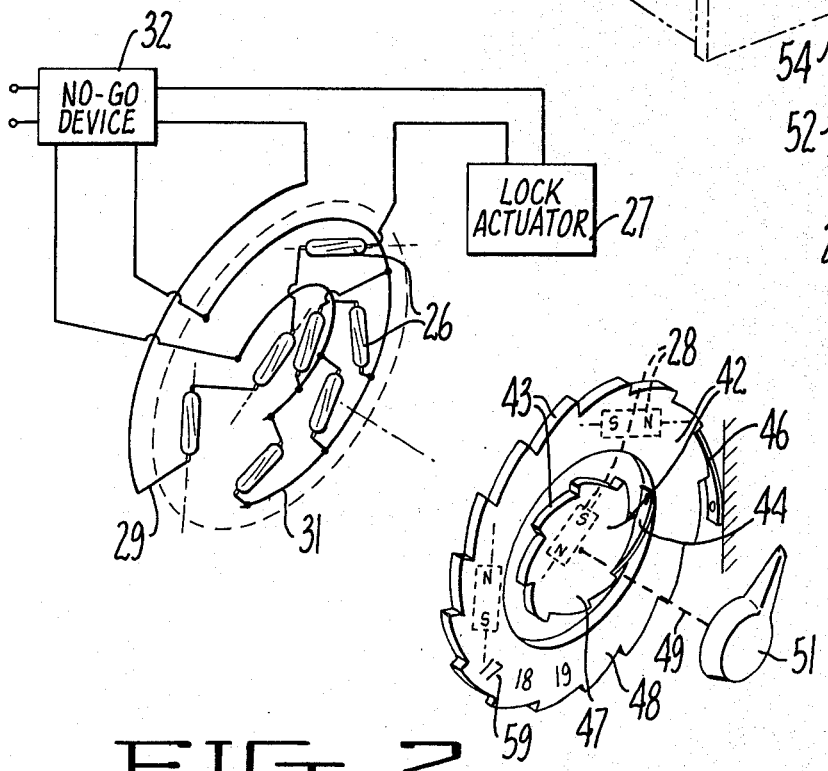
FIG. 2 is a partially schematic perspective of the operating system of the locking device.

The two ratchet wheels 47 and 48 and their respective pawls 44 and 46 are oriented opposite in rotational sense to each other so that as seen in FIG. 2, when the knob 51 is rotated in a counterclockwise direction the ratchet wheels 47 and 48 will be moved together in a counterclockwise direction, and as the knob 51 is rotated in a clockwise direction the ratchet wheel 47 will be rotated alone. Thus a combination lock is provided within the key portion 23.

The elements of the key portion 23 are mounted in a case 52 having the knob 51 on its front face 53. For the purposes of the embodiment of FIG. 1, the rear side of the case 52 is provided with a sloping locator lip 54 which mates with a similarly sloped portion 56 located at the upper edge of the barrier 24. The front face 53 of the case is provided with a dial device which includes the knob 51 and a circular series of dial indicia 57 for indicating rotational position of the knob 51. The front face 53 is also equipped with an indicator window 58 for viewing the indicia 59 marked on the outer ratchet wheel 48 to indicate its rotational position.

The magnets 28 are preferrably small dimension bar magnets. If it is desired to make the key portion 23 unique to a particular series of lock portions 22 two or more of the small magnets 28 may be mounted on one of the rotating elements 47 or 48 of the key portion 23. Once two such magnets have been affixed to a single one of the rotating elements, and the corresponding magnetic reed switches 26 in the lock portion aligned correspondingly, then the lock portion 22 may be opened only by a key portion 23 having a pair of the magnets similarly permanently fixed with respect to each other. Of course, it should be appreciated that a similar purpose may be accomplished by providing one or more fixed non-rotatable magnets within the key portion.

Fixing a pair of the magnets 28 with respect to each other in this fashion, however, limits the choice of combinations available to be built into lock and key pairs to distinguish them from other similar lock and key pairs. Accordingly, where it is desirable to retain the largest possible number of permutations of magnet positions, additional rotatable elements may be provided in concentric relation in the key portion 23 with a single magnet to each rotatable element as depicted schematically in FIG. 19. In such a device it would be desirable to eliminate the ratchet arrangement shown in FIG. 2 and provide instead pairs of mating dogs between each rotating element and the element next to it in the fashion customarily employed in combination locks.

The locking device of the present invention is shown, for illustrative purposes only, as being applied to a coin acceptor of the type usually associated with coin-operated machinery. Such coin acceptors 61 customarily have an outer casing or enclosure of heavy-gauge steel designated here as 62 and generally possess some means for inserting coins to activate the coin-operated machinery such as the coin injector slide shown here as 63. However, the coin injector slide 63 is no part of the present invention and might as readily be replaced by a simple slot or other forms of coin genuineness-verifying devices. The coin acceptor 61 is equipped with a coin receiving drawer which is normally locked into place within the housing 62. To periodically empty the coins received by the acceptor 61, the drawer 64 is unlocked and withdrawn for emptying.

The acceptor 61 is also provided with an access hatch 66 which may be opened to gain entry to portions of the housing of the acceptor which do not receive coins and may contain cycling switches, timers, etc. This hatch 66 is commonly secured with a lock 67 of a less high degree of security than that used for the coin drawer as no money is usually accessible through the hatch 66. The hatch 66 provides the secured access referred to above in which the reset switch or manual switch handle of the circuit breaker may be located for resetting the NOGO device in the form of the invention shown in FIG. 13.

Figure 3:
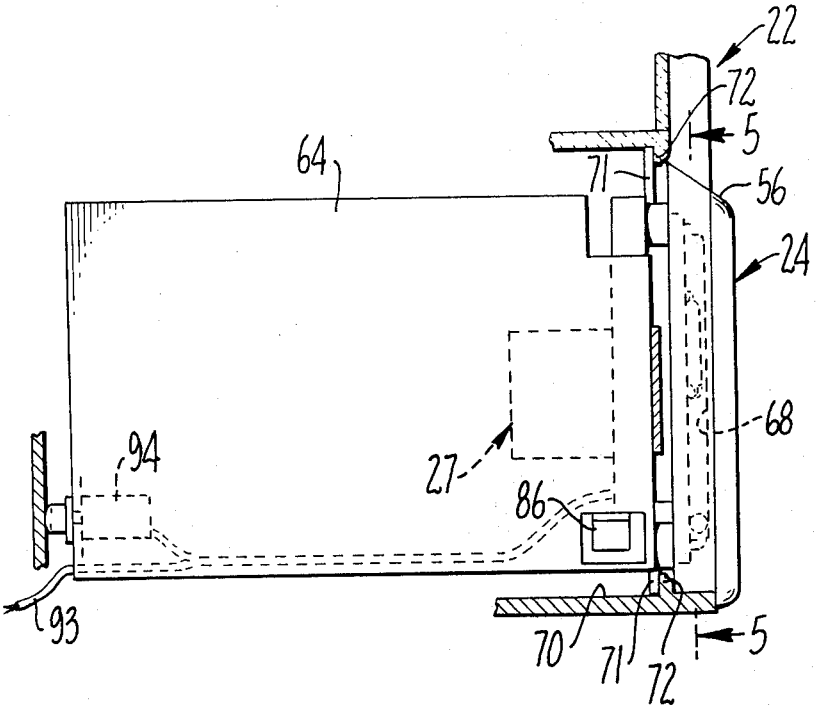
FIG. 3 is a cross-sectional view on an enlarged scale, taken approximately along the plane of lines 3—3 of FIG. 1.
Figure 4:
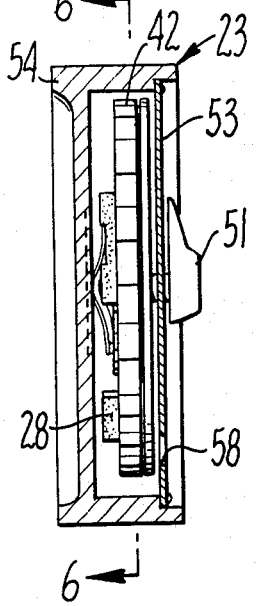
FIG. 4 is a cross-sectional view on an enlarged scale, taken approximately along plane of lines 4—4 of FIG. 1.
Figure 5:
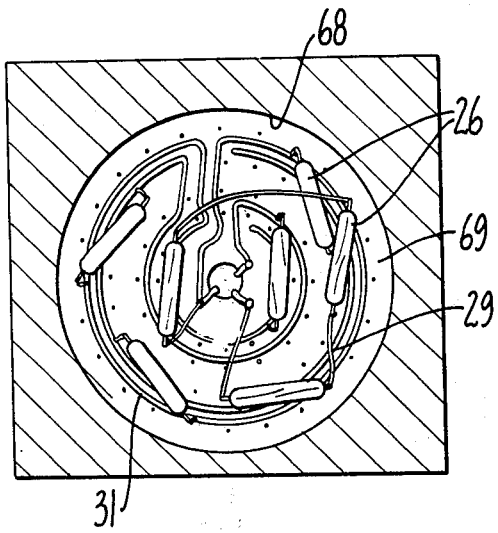
FIG. 5 is a cross-sectional view taken approximately along the plane of lines 5—5 of FIG. 3.
Figure 6:
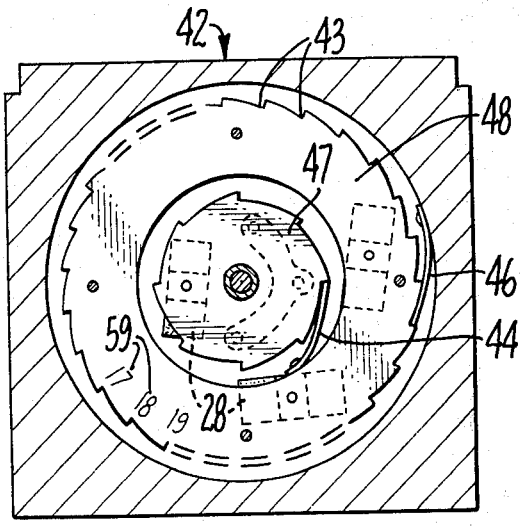
FIG. 6 is a cross-sectional view taken approximately along the plane of lines 6—6 of FIG. 4.
Figure 7:
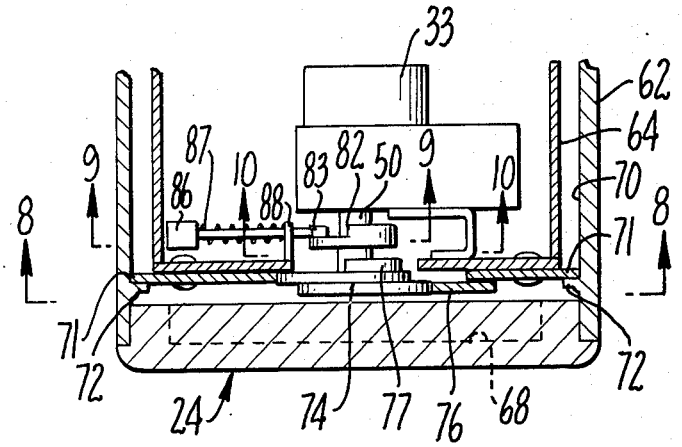
FIG. 7 is a fragmentary cross-sectional view on an enlarged scale taken approximately along the plane of lines 7—7 of FIG. 1.
Figure 9:
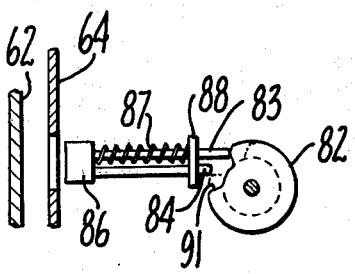
FIG. 9 is a fragmentary cross-sectional view of the manual reset mechanism taken approximately along the plane of lines 9—9 of FIG. 7.

As shown in FIGS. 3 and 7, the front of the drawer 64 forms the barrier 24 and constitutes an imperforate closure plate of substantial thickness having a hollowed out portion 68 in its rearward side. As shown in FIG. 5, the magnetic reed switches 26 are disposed within the hollowed out portion 68, held in a fixed array on a circuit board 69. Immediately behind the barrier 24 which serves as the front of the drawer 64 are a pair of locking bolts 71. These bolts are shown in extended position in FIG. 3. In extended position, they lock behind a lip 72 which surrounds the opening or receiver portion 70 in the casing 62 of the acceptor 61 into which the drawer 64 is inserted.

Figure 8:
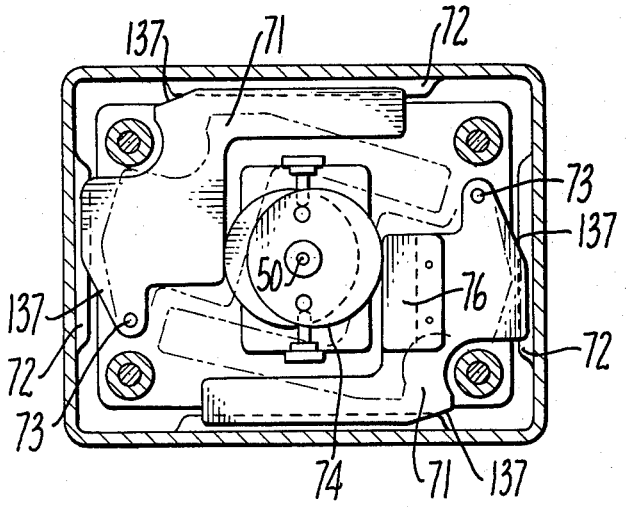
FIG. 8 is a cross-sectional view taken approximately along the plane of lines 8—8 of FIG. 7.
Figure 10:
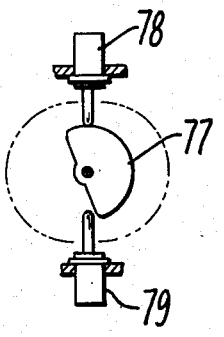
FIG. 10 is a fragmentary cross-sectional view of the cycling cam and switches, taken approximately along the plane of lines 10—10 of FIG. 7.

As shown in FIG. 8, the lock bolts 71 are generally L-shaped in form and pivotally attached to the body of the mechanism through bearings 73. In the position shown in solid lines in FIG. 8, the lock bolts are extended to lock the drawer into the acceptor, and the position shown in phantom represents the retracted position of the bolts 71. The lock bolts 71 are extended by a double eccentric cam 74 formed of two circular eccentric cams phased 180 rotational degrees apart.

Figure 11:
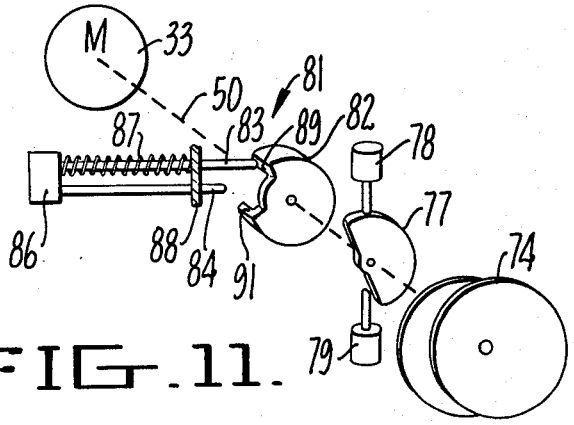
FIG. 11 is a semi-schematic exploded perspective view of the cam and manual reset system of the locking device.

As may be seen in FIGS. 7 and 11, the two eccentric circles forming the cam 74 are slightly axially offset from each other on the shaft 50 of the motor 33, so that those portions of the lock bolt 71 which act as followers for the cam will each ride on only one of the circles. To allow for the axial offset of one of the circles with respect to the other, the follower portion 76 of one of the locking bolts 71 is corresponding offset in the same direction as the circle of the cam 74 which it follows. To bias the lock bolts 71 against the cam 74 for retraction, a conventional spring, not shown, may be extended between the distal ends of the lock bolts 71.

The shaft 50 also bears a generally D-shaped cam 77 which is followed by a pair of limit switches 78 and 79.

The two limit switches 78 and 79 operate to control the opening and closing steps of the lock mechanism as may be seen from the circuit diagrams of FIGS. 12 and 13. This operation is described in greater detail below.

The shaft 50 is equipped with a manual advancing means 81 for advancing the cams 74 and 77 from their position when the apparatus is in the unlocked state to a condition of readiness to relock. The manual advancing means 81 includes a generally cup-shaped cam-like member 82 attached to the shaft 50, a longer finger 83 and a shorter finger 84 attached to a finger-actuatable button 86, and a compression spring 87 biasing the fingers 83 and 84 and the button 86 away from the cam-like member 82. As may be seen in FIG. 3, the button 86 is accessible through a hole in a lower side wall of the drawer 64 so that it may be manually actuated to place the lock mechanism in condition for relocking. The two finger members 83 and 84 pass through appropriate holes in bracket 88 which supports the fingers 83 and 84 and the button 86.

To advance the shaft 50, the button 86 is pressed inward, driving the longer finger 83 against an edge of the cutaway portion 89 of the cup-shaped member 82. The longer finger 83 thus urges the cup-shaped member 82 to rotate in a clockwise direction as seen in FIG. 11 and carries the shaft 50 in a clockwise direction with it. The shorter finger 84 also advances together with the longer finger 83, but due to its shorter length, it contacts the cup-shaped member 82 after the longer finger 83 has rotated the member 82 several degrees.

The operation of the opening and closing cycles of the locking device may best be understood by reference to FIG. 12. In this figure the cam 77 is shown in the approximate position that it occupies when the lock portion 22 is in the locked condition and ready to be reopened. Electric power is supplied from a source generally indicated at 92 through a power supply line 93 (FIG. 3) which passes out through the rear of the drawer 64 and into the rear portion of the coin acceptor 61. A switch 94 is located so that it is closed when the drawer 64 is fully inserted into the coin acceptor 61. As shown in FIG. 3, the switch 94 is located at the rear of the drawer 64 for actuation by abuttment against an inner portion of the casing 62. Of course, a number of other appropriate locations might be employed, the important thing being that the switch 94 be closed by full insertion of the drawer 64 into the coin acceptor 61.

The switches 78 and 79 are in parallel relationship to each other and in series relationship with the switch 94, and the switch 78 is also in series with the series circuit 29 of switches 26 in the line of supply of power to the motor 33. When the locking device 21 is in the state shown in FIG. 12, closure of all of the switches 26 in the series circuit 29 will supply electric power through the switch 94, the switches 26 in the series circuit 29, the closed switch 78 and thence through the driving coil 34 of the motor 33. This is the condition in which the lock begins to open, and provided none of the switches 26 of the series circuit are opened and none of the switches 26 of the parallel circuit 31 are closed, the motor 33 will operate to rotate the cam 77 counterclockwise through slightly less than one half rotation to the point at which the switch 78 is opened.

Due to the slightly right-of-center location of the cam 77 as seen in FIG. 12, switch 79 will still be open at the point of opening of switch 78 when the motor 33 stops. At this rotational position of the cam 77, the double eccentric cam 74 has fully retracted the lock bolts 71 and the drawer 64 is free for removal from the coin acceptor 61. Despite continued closure of switch 94 until the drawer 64 is removed from the coin acceptor 61 the motor 33 cannot operate because both switches 79 and 78 are simultaneously open.

When it is desired to reclose the locking device 21, the advancing means 81 is operated by manual finger pressure on the button 86 to advance the cam means 77 slightly counterclockwise, to the point at which switch 79 closes while switch 78 remains open. Since the drawer 64 must be pulled at least a small amount out of the coin acceptor 61 to reach the button 86 of the manual advancing means 81, the switch 94 will be opened so that no electric power can be supplied to the motor 33 until the drawer 64 is reinserted. Upon reinsertion of the drawer 64, the switch 94 is closed by impingement against the back wall of the recess 70 which receives the drawer 64. Electric power is then supplied through switch 94 and switch 79, then closed, to the driving coil 34 of the motor 33.

The motor 33 then drives the cam 77 approximately a half revolution counterclockwise as seen in FIG. 12 to return it finally to the position shown, with the switch means 79 opened. The opening of the switch means 79 terminates the supply of current to the driving coil 34 of the motor 33 and its operation then ceases. In this position of the cam means 77, the lock bolts 71 are fully extended and the drawer 64 is once again locked in place within the coin acceptor 61 until such time as the key portion 23 is reapplied to the barrier of closure plate 24.

From the diagrams of FIGS. 12 and 13 it may be seen that the switches 78 and 79 actuated by the cam 77 are essentially connected in parallel relationship with each other and in series relationship with the switch 94 in the line of supply of power to the motor 33. Switch 78 is essentially in series relationship with the series connected magnetic reed switches 26 of the series circuit 29.

Two new features are introduced in the embodiment shown in FIGS. 14 and 15, the elimination of the slide-out coin drawer 64 and the non-obvious location for the application of the key portion 23 to the lock portion 22. In this embodiment the outer casing or enclosure 62 is marked on at least one surface with a number of locator marks shown here as intersecting grid lines 96. Certain of the marks 96 define a correct location for the placement of the key portion 23 against the lock portion 22, and the magnetic reed switches within the lock portion 22 are positioned adjacent that correct location so that they are actuatable by the key portion 23 when it is applied to that location in correct orientation.

It may readily be seen that a number of incorrect locations for the positioning of the key portion 23 against the lock portion 22 are defined by the locator marks 96, so that the opening procedure of the lock is made more sophisticated and still less susceptible to tampering or defeat. With this arrangement, it is desirable to make the correct location unobvious, and for this purpose the locator marks 96 would be created in a fashion such as embossing or etching in a piece of highly wear-resistant material such as stainless steel. The repeated application of the key portion 23 to the correct location would thus not give away the correct location through showing wear marks on the lock portion 22.

Within the lock portion 22 the circuit board 69 bearing the magnetic reed switches 26 would be located at the time of manufacture at the desired location and securely affixed in that location. While the locator marks 96 have been here shown as an intersecting set of grid lines, it should be appreciated that a wide variety of non-obvious location symbols providing one correct and a number of incorrect location identifications could be likewise employed, such as field of dots or a pattern of lines radiating from centers, for example.

The key portion 23 for use in this embodiment would be constructed without the locator lip 72 and the barrier or closure plate 24 need not be formed with the bevelled portion 56. While the key has been here shown has been applied to the top of the coin acceptor 61 any accessible exterior surface of the acceptor 61 would also be suitable. With the non-obvious location for correct key placement as shown in FIG. 14, defeat of the locking device 21 by means other than physical forcing becomes a Herculean task, as the would-be thief must not only possess the correct key and know the correct combination to dial into the correct key, but further must know the correct location for application of the key to the lock.

The other feature illustrated in FIGS. 14 and 15 is the absence of the coin drawer 64. In this embodiment the coins are collected within the coin acceptor 61 in a receptacle 97 having a generally hopper-shaped bottom. It may be seen from FIG. 15 that the coins constitute an essentially flowable material and they roll and slide to the bottom of the receptable 97. While coins are shown as the dispensed matter, any flowable material might likewise be dispensed. The hopper-shaped bottom of the receptacle 97 is closed off by a valve member or door 98, which is pivotally mounted about a pin 99. The valve member or door 98 leads to a chute 111 which leads in turn to the exterior of the outer casing 62 of the lock portion 22.

In this embodiment, the electromotive device or lock actuator 27 is one capable of producing a linear motion which is imparted through a linkage 112 to the valve member or door 98. The linkage 112 includes an elongate member 113 which is moved vertically as shown in FIG. 15 by the electromotive device 27, a bell crank 114 which is pivotally mounted on the inner portion of the lock by a bracket 116, and a latch member 117. The elongate member 113 and the latch member 117 are pivotally connected, one to each of the arms of the bell crank 114.

Thus it may be seen that the extension of the member 113 vertically upwards as seen in FIG. 15 will cause the latch member 117 to retract to the left. The latch member 117 engages an arm 118 attached to the door 98 to retain the door 98 in its closed position. Retraction of the latch member 117 to the left thus frees the arm 118 and the door 98 to allow them to move to the position shown in phantom in FIG. 15. The coins then flow out of the hopper 97 and down the chute 111 to the exterior of the coin acceptor 61.

To prevent straight line intrusion of forcing tools into the vicinity of the door 98 through the chute 111, the chute 111 has at least one sharp bend such as that indicated at 119. Since rotary motion of the actuator 27 is not required in the embodiment shown in FIGS. 14 and 15, a number of other forms of electrically actuated devices could be employed in the locking device shown here. For instance, the lock actuator 27 could be a solenoid, with the member 113 attached to the moving core of the solenoid for movement away from the actuator 27 when power is supplied to the actuator.

Another form of electromotive device 27 which may be used to actuate the lock is schematically illustrated in FIG. 21. In this form, the actuator is a thermal device which includes an electric heater element 121 and a thermal expansive element 122 which is connected to the linkage 112 through the member 113. Such a thermal expansive element 122 could be a bimetal strip pivotally connected to the lower end of the member 113 and so arranged as to curve upwardly to the position shown in phantom in FIG. 21 upon application of heat from the electric heater element 121. The curving movement of the thermal expansive element 122 thus produced would be transmitted into linear upward motion of the member 113 through the pivotal connection. Other types of thermal expansion such as that producible by a gas-filled bellows or syphon-like device would also be suitable if transmitted from the expanding element to the member 113.

If the electromagnetic device or lock actuator 27 is to be an electric motor, the member 113 could be connected eccentrically to a disc member rotated by the motor to convert the rotary motion to linear motion of the member 113. If a rotary motion device such as an electric motor 33 is employed in this instance, it would be desirable to provide a cycling cam 77 similar to that shown in the preceding embodiment bringing the rotating disc member to a halt approximately every half revolution. If an electric motor or a solenoid is used, either the bucking coil NOGO device illustrated in FIG. 12 or the circuit breaker NOGO device illustrated in FIG. 13 could be applied, but with the thermally actuated device of FIG. 21 the NOGO device would be limited to a circuit interrupter such as that shown in FIG. 13.

While the two features, the elimination of the coin drawer and the non-obvious location for application of the key to the lock have been shown together in the embodiment of FIGS. 14 and 15, the two features are not dependent upon each other, and the non-obvious key location feature could be applied to a drawer-type coin receptacle as shown in the preceding embodiment. The drawerless coin collection feature of the embodiment of FIGS. 14 and 15 could likewise be equipped with the obvious key location feature of the embodiment of FIGS. 1 through 10.

Figure 17:
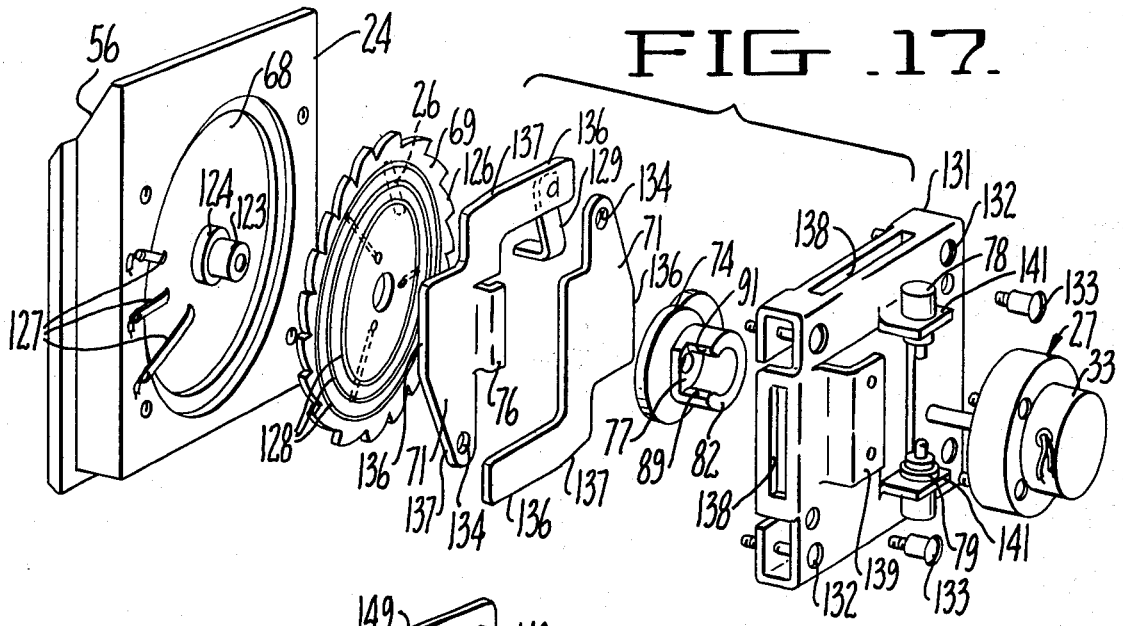
FIG. 17 is an exploded perspective view of the drawer front of the lock portion of another embodiment of the present invention.
Figure 18:
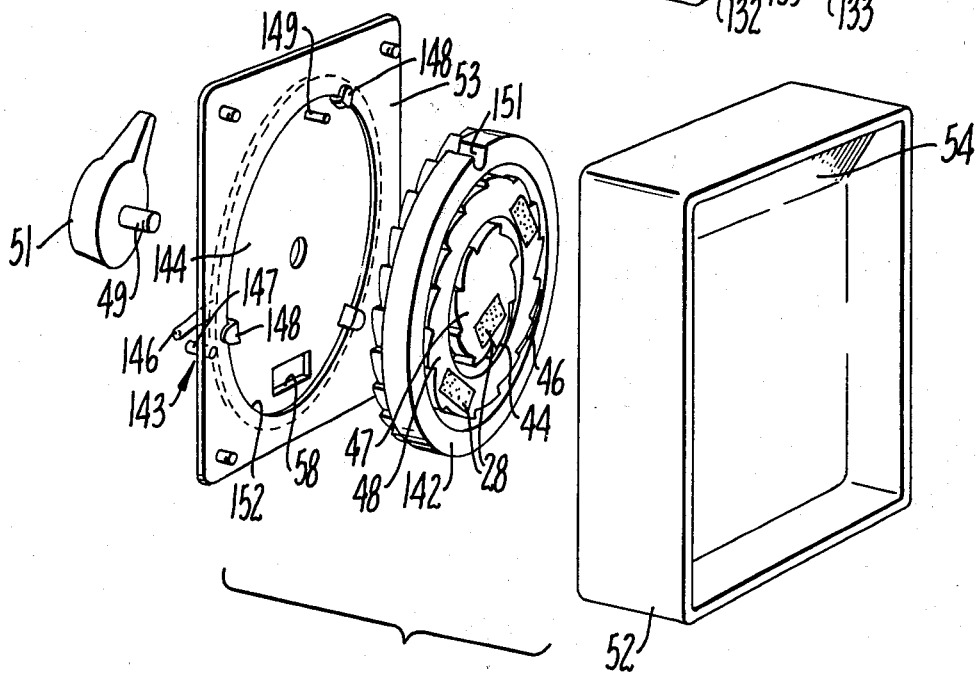
FIG. 18 is an exploded perspective view of the key portion corresponding to the lock portion of FIG. 17.

In the embodiment of the invention shown in FIGS. 17 and 18, a number of the switches 26 are mounted on the circuit board 69 on the side of the circuit board 69 facing the front of the closure plate 24 as before, and the circuit board 69 is made rotatable about a hub 123. The hub 123 has a shoulder 124 which spaces the circuit board 69 slightly away from the front of the hollow portion 68 to allow clearance for the switches 26. In this embodiment the circuit board 69 is disc-shaped and formed with ratchet teeth 126 at its outer periphery. Since the circuit board 69 rotates, electrical contact to the magnetic switches 26 is made through a slip-ring commutator arrangement. The commutator has three contact fingers 127, each is sliding contact with one of three conductive rings 128 located on the opposite face of the circuit board 69 from the switches 26. The appropriate connections to the series and parallel circuits 29 and 31 of the switches 26 are made from the rings 128 through the circuit board 69 to its front face, that is, the face which is hidden in FIG. 17.

The disc-shaped circuit board 69 is advanced a determined fraction of rotation on each cycle of opening and closing of the locking device by a pawl 129 pivotally attached to the distal end of one of locking bolts 71. The pawl 129 engages a new one of the ratchet teeth 126 each time the locking bolt 71 is retracted to the unlocked position and advances that tooth to rotate the circuit board 69 each time the locking bolt 71 is extended to the locked position. The pawl 129 may be biased toward the center of the circuit board 69 by a suitable spring means, not shown, Also shown in FIG. 17 and appropriate as well to the embodiment of FIGS. 1 through 10 is the mounting plate 131 which is fastened to the rear of the closure plate 24 by screws 132. Screws 133 pass through the mounting plate 131 and through apertures 134 in the lock bolt 71 to provide the bearing 73 about which the lock bolt 71 pivots. Each of the lock bolts 71 is equipped with a pair of latching surfaces 136 and a pair of relieved portions 137 adjacent the latching surfaces 136, so that the locking bolt 71 will clear the lip 72 on retraction. When the apparatus is assembled, the lock bolts 71 are disposed within the mounting plate 131 and the latch surfaces 136 pass out through the sides of the mounting plate 131 through slots 138. The motor 33 is mounted on the mounting plate 131 by a bracket 139 and the switches 78 and 79 are carried on bracket 141 attached to the mounting plate 131.

The key portion 23 corresponding to the lock mechanism shown in FIG. 17 is shown in FIG. 18. As previously, the magnets 28 are carried on a pair of rotating ratchet wheels 47 and 48. However, in the present embodiment the radially outermost ratchet wheel 48 is borne in turn by a rotatable disc 142. A dialing mechanism including a shaft 49, a knob 41 and dial indicia 57, not shown in this view, is coupled to the ratchet wheels 47 and 49 to selectively rotate the ratchet wheels 47 and 48 with respect to each other and with respect to the rotatable disc 142.

In the present embodiment the key portion 23 is equipped with an advancing mechanism effective to rotate jointly all of the dial mechanism, the ratchet wheels 47 and 48 and the disc 142, to correspond to the rotary advancement of the circuit board 69 bearing the switches 26 within the lock portion 22. The advancing mechanism 143 includes a rotatable face plate 144 which bears, on the face hidden from view in FIG. 18, the dial indicia 57 and is pierced by the indicator window 58, a lever 146 attached to the rotatable face plate 144 and accessible from the outside of the key portion 23, a face plate 144, and retainer clips 148 which secure the rotatable face plate 144 to the front face 53 of the case 52.

A stop pin 147 may also be provided, if desired, to assist in locating the home position of the lever 146. To allow for this form of mounting of the face plate 144 on the face plate 53, a circular aperture 152 slightly smaller in diameter than the face plate 144 is cut in the face plate 53, and the retainer clips 148 are set on the back of the face plate 144 to pass through the circular opening 152 and slideably engage the edge of that opening and the back of the face plate 53. A pin 149 secured to the back of the face plate 144 engages a corresponding slot 151 in the rotatable disc 142 so that the disc 142 and the face plate 144 rotate together. Suitable indicia may be marked if desired on the front face of the face plate 53 to indicate the rotational position of the lever 146.

To assure correct dialing of the combination for the ratchet wheels 47 and 48, the rotatable disc 142 and the face plate 144 may be returned to a homing position before each operation of the key by bringing the lever 146 back to the stop pin 147. The lever 146 is then held in that position while the correct combination is dialed for the ratchet wheels 47 and 48 be clockwise and counterclockwise rotation of the knob 51. When this is complete, the level 146 is rotated to bring the entire inner mechanism of the key portion 23 to the rotational position corresponding to the last advancement of the circuit board 69 and switches 26 within the lock portion 22. It is necessary for the operator of the key portion 23 to remember what the last correct positioning of the lever 146 was so that he may position the lever 146 one increment farther in the clockwise direction than the previous setting to accommodate the movement of the circuit board 69.

In effect, the advancing mechanism 143 in the key portion 23 is simply another combination setting element, and it should be appreciated that the stop pin 147 and the return to the home position of the rotatable face plate 143 are not, strictly speaking, necessary to the operation. They could, for instance, be replaced by a small pinion gear engaging the edge of the rotatable face plate 144 and operated by an appropriate knob, or the rotatable face plate 144 could be left entirely free to rotate without any particular home position, provided it was rotated to the correct location at the end of the combination setting process after the ratchet wheels 47 and 48 were dialed to the correct combination.

Figure 16:
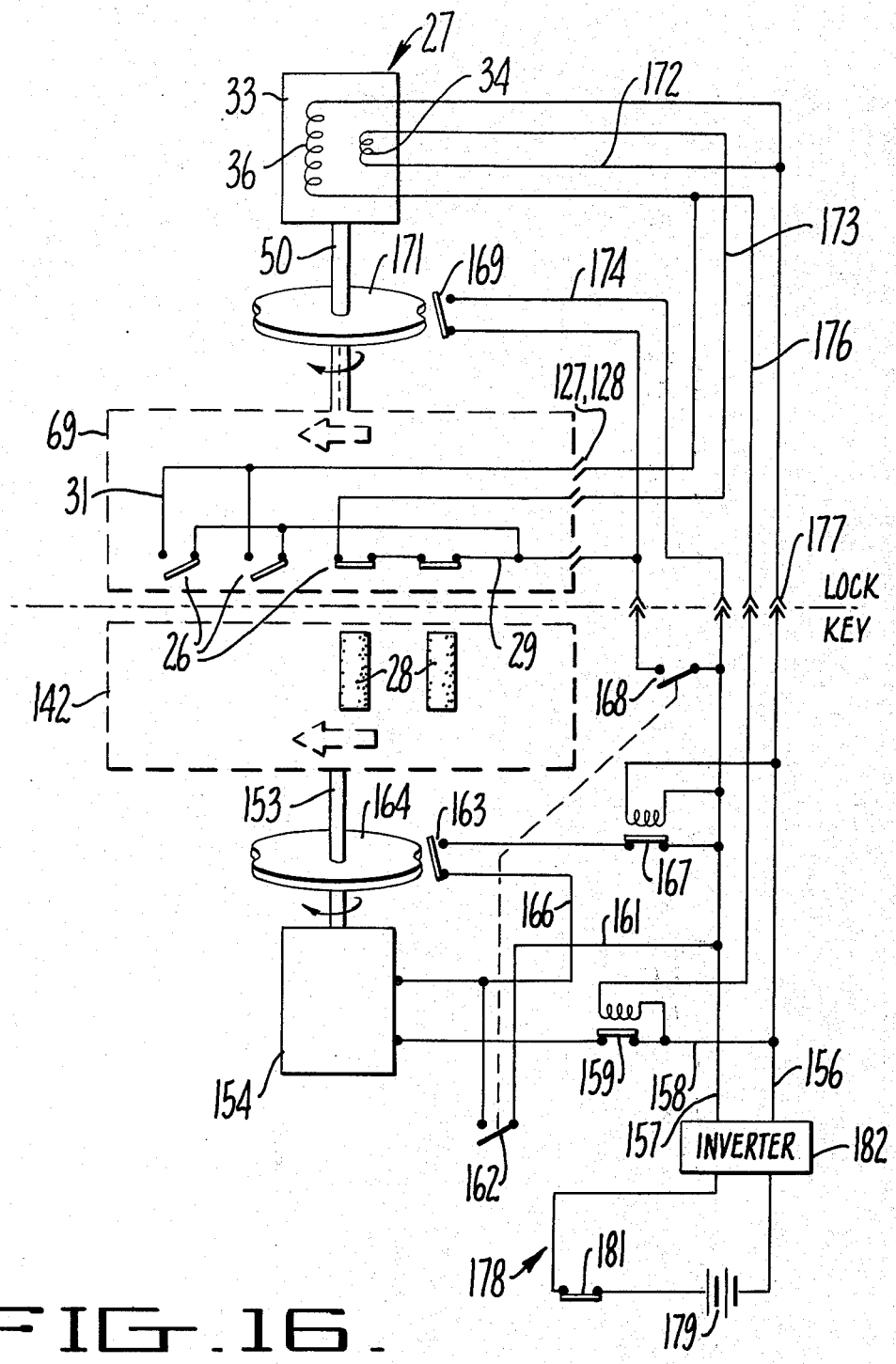
FIG. 16 is a schematic diagram of the electrical circuit of another embodiment of the locking device of the present invention.

Another approach to providing added sophistication in the locking device 21 of the present invention is that schematically shown in FIG. 16. In this embodiment, the magnetic switches 26 are mounted as before on a circuit board 69 which is formed as a rotatable disc within the lock portion 22, and the magnets 28 and their associated ratchet wheels are mounted on a second rotatable disc member schematically indicated as 142. However, in contrast to the preceding embodiment, the circuit board 69 is here coupled to the shaft 50 of the electric motor 33 within the lock portion, and the electric motor 33 is of the synchronous type. Within the key portion 23 the rotatable member 142 is coupled to the shaft 153 of a second synchronous motor 154, so that the circuit board 69 and the rotatable member 142 are rotated in synchronism in the same rotational direction during the opening cycle of the locking device 21, and the magnets 28 are maintained in alignment with the switches 26 as the magnets 28 and switches 26 jointly rotate.

While the two electromotive devices 33 and 154 have been described here as synchronous electric motors, it should be appreciated that what is required in these two electromotive devices is that the two together essentially form a mechanism for maintaining synchronism of movement of the two shafts 50 and 153. Accordingly, the two electromotive devices 33 and 154 could also be a Selsyn-type transmitter and receiver pair, with the transmitter preferably being located in the lock portion 22.

The synchronous motor 33 is equipped with the previously described driving coil 34 and bucking coil 36, while the motor 154 requires only a driving coil, not shown. The driving coil 34 and the bucking coil 36 are supplied with electric power through the series circuit 29 and the parallel circuit 31 respectively as in the previous embodiments. As the circuit board 69 revolves in this example, the connections to it are made through contact fingers 127 and rings 128 essentially similar to those depicted in FIG. 17.

The two electric motors 33 and 154 are supplied with power along a pair of power lines 156 and 157 shown here as originating in the key portion 23. However, the power source for the power lines 156 and 157 could also be located in the lock portion 22. Electirc power is supplied to the motor 154 along a line 158 leading from line 156 through a NOGO interrupter relay 59 and from thence to the motor 154. The line 158 also supplies driving power to one side of the coil of the NOGO interrupter relay 159. The relay 159 is a normally closed relay which is powered to interrupt conductor 158 as described below.

The circuit for motor 154 is completed through two alternate paths, one being along a line 161 through a normally opened start switch 162 and thence to the power supply line 157, and the other being along a line 166 passing through a normally open cycling switch 163 which is operated by a cycling cam 164, and thence through a GO failure relay 167 back to the power supply line 157. The GO failure relay 167 is of the normally closed type and is opened in response to the opening of one of the switches 26 in the series circuit 29 within the lock in a fashion described below. The driving coil of GO failure relay 167 is supplied with power from the power supply conductors 157 and 156.

It may be seen that the start switch 162 acts as a bypass to the cycling switch 163 which is open at the point in the cycle when the disc members 69 and 142 first begin to rotate. Since the switch 162 serves only as a bypass until switch 163 is closed by rotation of the cam 164 it may be spring-loaded open or it may be of the momentary contact type. A second starting switch 168 is ganged together with the starting switch 162 for joint operation in a similar fashion to bypass the cycling switch 169 in the lock portion. The cycling switch 169 operates in a fashion similar to the cycling switch 163 in the key portion, being a normally open switch closed by the action of the cycling cam 171 on the shaft 50 in the lock portion 22.

As the operation of the lock portion is begun, power is supplied to the motor 33 from the power supply line 157 through the starting switch 168 and from thence through the series circuit 29 through a line 173 to the driving coil 34. The circuit is completed from the driving coil 34 back to the power supply line 156 through a line 172. As the cam 171 begins to rotate, it closes switch 169 to establish a circuit from power supply line 157 through a line 174 and the switch 169 to the series circuit 29, and the starting switch 168 may then be released without interrupting the supply of power.

Similarly the cycling cam 164 in the key portion 23 closes the cycling switch 163 as it begins to rotate, to supply power from power supply line 157 through the GO failure relay 167, the switch 163 and line 166 to the motor 154. If all conditions are correct, both motors 33 and 154 will continue to rotate, driving the cycling cams 164 and 171 and the disc members 69 and 142 for one-half rotation, until the opposite indentation in each of the cams 171 and 164 reaches the respective cycling switch 169 and 163. At this point, the supply of electric power is both motors is interrupted by the opening of the cycling switches 163 and 169 and the rotation of both the switches 26 and the magnets 28 is brought to a halt. This condition corresponds to the full withdrawal of the locking bolts 71 and the opening of the lock portion 22.

It can thus be seen that complete synchronism of the movement of the switches 26 on the circuit board 69 and of the magnets 28 on the rotatable disc 142 is required. Any failure to keep the magnets moving exactly in step with the movement of the switches 26 will result either in the opening of one of the switches 26 in the series circuit 29 or the closure of one of the switches 26 in the parallel circuit 31, with either event interrupting the operation of motor 33 in the fashion previously described.

To maintain the necessary rotary phase relation between the key portion 23 and the lock portion 22 it is necessary to provide for the interruption of the motor 154 in the key portion should the motor 33 in the lock portion 22 be interrupted by either failure of the GO circuit 29 or operation of the NOGO circuit 31. For this purpose the NOGO parallel circuit 31 is not only connected to the bucking coil 36 at the motor 33 but is also connected to a line 176 leading to the other end of the driving coil of the NOGO interrupter relay 159 in the key portion 23. Thus should the NOGO parallel circuit 31 be energized, the bucking coil 36 will stop the motor 33 and the supply of power along line 176 to the NOGO interrupter relay 159 will cause that normally closed relay to open and terminate the supply of power to the motor 154.

The motor 154 also needs to be halted should any of the switches of the GO circuit 29 be opened. For this purpose the GO failure relay 167 is connected across the two power supply lines 156 and 157. The driving coil of the relay 167 is designed to have a pull-in current sufficiently high that it is not operated if current is passing through the driving coil 34 of the motor 33. Whenever the circuit through the driving coil 34 of the motor 33 is interrupted, such as by the opening of one of the switches 26 in the series circuit 29, sufficient current is then available from the power supply lines 156 and 157 to operate the driving coil of the relay 167 and interrupt the supply of power along line 166 to the motor 154.

This embodiment requires that a pair of mating connectors 177 be provided on the lock portion 22 and the key portion 23 to couple the power on lines 156, 157 and 176 and from switch 168 from the key portion to the lock portion. Such connectors are conventional in the art, and any suitable form may be used.

As shown in the embodiment of FIG. 16 the power for the electric motors 33 and 154 is supplied from within the key portion 23 by a power supply generally indicated at 178. While the power supply may be from conventional domestic alternating current sources, it is advantageous from the standpoint of convenience and portabilty to provide it in the fashion shown here, including a battery 179, a switch 181, and an inverter circuit generally indicated as 182. The inverter circuit has been indicated only generally as any number of conventional inverters may be used. For compactness, the inverter used in the present application might well be constructed of solid state components. As pointed out above, although the inverter is shown located in the key portion of the apparatus, it could also be located in the lock portion 22 or AC power could be supplied from domestic sources through the lock portion 22 as in the preceding embodiments.

Figure 19:
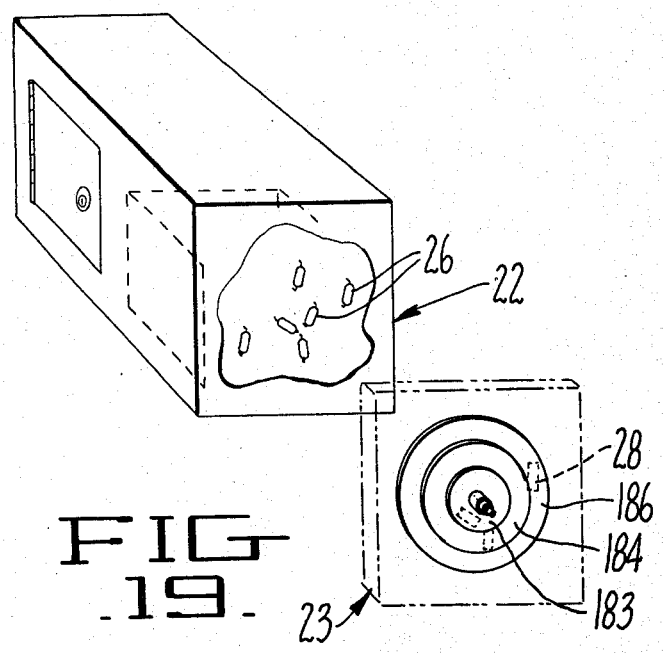
FIG. 19 is a schematic perspective view of another form of the locking device of the present invention, with portions shown broken away and portions in phantom.

FIG. 19 illustrates schematically the variation in construction of the key portion 23 in which the key includes three concentric wheels 183, 184 and 186, each bearing one magnet 28. The inner two of the wheels may be constructed akin to the ratchet wheels 47 and 48. In this form of the key 23, the uniqueness of the key is sacrificed in order to gain a wider range of possible lock combinations. With this form any combination can be dialed for any lock designed to go with such a three-ring key, as none of the magnets 28 are fixed in location with respect to each other. However, it should be clear that a key portion 23 of the three-ring type shown here will not operate a lock portion 22 intended for use with a unique type of key shown in the embodiment of FIG. 1 through 10, as such a lock portion 22 has two of its GO switches 26 located on the same radius, while the key portion 23 of the three-ring form is not capable of positioning two magnets on the same radius.

Figure 20:
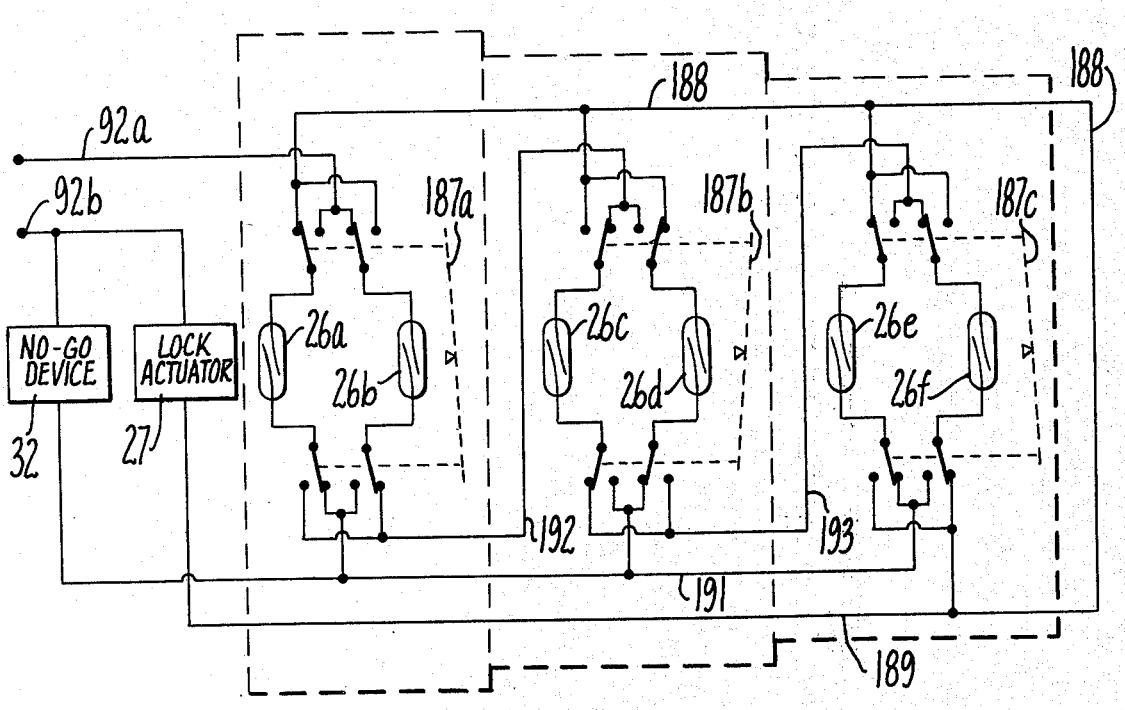
FIG. 20 is a schematic diagram of the electrical circuit of another embodiment of the present invention.

In the form of the switching circuit shown in FIG. 20, the function of the switches 26 in the lock portion 22 may be inverted in effect, that is, all of the GO series switches changed to NOGO parallel switches and vice versa. The switching circuit of this form includes a number of four-pole double-throw switches 187, with one 4PDT switch 187 associated with each pair of magnetic switches 26. While the switches 187 are shown independent of each other, they may also be ganged together for joint operation. The magnetic switches 26 are wired in pairs 26*a* and 26*b*, 26*c* and 26*d*, and 26*e* and 26*f*. One of the switches 26 in each pair serves the GO function and the other serves the NOGO function at any given time. Power is supplied as in the embodiments of FIGS. 12 and 13 from a source generally indicated as 92, which may, if desired, be switched by a switch 94 as in the embodiment of FIG. 12. One of the power lines 92*b* proceeds directly to the NOGO device 32 and the electromotive device or lock actuator 27.

With the switches 187 in the configuration shown in FIG. 20, magnetic switches 26*a*, 26*d* 26*e* are connected in parallel and supply power to the NOGO device 32. Switches 26*b*, 26*c* and 26*f* are connected in series to supply power to the lock actuator 27. As in the case with the embodiments of FIGS. 12 and 13, the power is supplied through the series connected switches to a series bus line 189 and from thence to both the lock actuator 27 and through a line 188 for supply to the parallel-connected switches. The parallel-connected switches in turn communicate with a line 191 leading to the NOGO device 32.

Power is supplied from line 92*a* through the upper portion of switch 187*a* to switch 26*b*, thence through the lower portion of switch 187*a* to the interconnecting line 192. Line 192 supplies the power to the upper portion of the switch 187*b* from which it is supplied to the switch 26*c*, and thence through the lower portion of switch 187*b* to the interconnecting line 193. The line 193 supplies the power through the top portion of the switch 187*c* to the series bus line 189 and the line 188. Line 188 supplies power to the upper portions of all three switches 187*a*, 187*b*, and 187*c*. As those switches are set in FIG. 20 the power is thus supplied from line 188 through the upper portion of switch 187*a* and switch 26*a*, thence through the lower portion of switch 187*a* and to the parallel power bus 191, through the upper portion of switch 187*b* and switch 26*d* and thence through the lower portion of switch 187*d* to the parallel bus 191, and also through the upper portion of switch 187*c*, switch 26*e* and a lower portion of switch 187*c* to the parallel bus 191.

Switching any of the switches 187 will thus invert the function of the pair of switches 26 controlled by that particular switch 187. The combination of the lock may thereby be changed in whole or in part either periodically, or in a crisis situation such as the loss of a key portion 23. Upon change of the combination a new key portion 23 would generally be required. Where the combination is periodically or at random changed for greater security, the various key portions 23 corresponding to all of the potential combination changes possible through the use of switches 187 might be supplied at the time that the locks were supplied. However, for crisis changes of combination, a new key portion 23 corresponding to the totally or partly inverted combination might be supplied by a distributor or from the factory.

The switches 187 would be located near a separate access means such as the access hatch 66 (FIG. 1). The lock 67 on the access hatch 66 thus need not have the same level of security as the locking device 21 of this invention, as it is not possible to defeat the locking device 21 merely upon having access hatch 66 to the switches 187. Nonetheless, a moderate degree of security on the access hatch 66 is desirable to render the use of a stolen key portion 23 more difficult.

From the foregoing it may be seen that a locking device has been provided which is highly secure against picking and forcing. The lock possesses no keyhole and has a NOGO device and a great number of possible combinations to block tampering. The key shown may be made unique to a series of locks, and the location of its application to the lock may be unobvious. The entire apparatus is capable of automatic change of combination.

We claim:

1. A keyhole-less, drawerless, coin-collecting security device for a coin-operated machine comprising in combination:

a. a receiver structure formed, at least in part, from a magnetic field permeable material; said structure providing a barrier to physical penetration thereof;

b. a coin slot means on said receiver for introducing coins into said receiver;

c. coin storage means disposed within said receiver in coin receiving relationship to said coin slot means, said storage means being adapted to contain simultaneously a multiplicity of coins and being provided with a hopper-shaped bottom;

d. chute means within said receiver leading from said hopper-shaped bottom to a discharge opening in the exterior of said receiver; said coin slot means and said discharge opening normally constituting the sole means of access from the exterior of said receiver to said coin storage means;

e. valve means, within said receiver movable from a closed position which blocks said chute to an open position which permits coin flow through said chute from said hopper to the exterior of said receiver;

f. magnetic locking means within said receiver, said locking means comprising:

i. magnetic field detecting means for detecting a predetermined externally generated magnetic field pattern; said magnetic field detecting means being located within said receiver and in proximity to said magnetic field permeable portion thereof; and, ii. actuating means for moving said valve means from said closed position to said open position; said actuating means being responsive to a predetermined magnetic field pattern detected by said magnetic field detecting means.

2. A security device as described in claim 1 and wherein said chute has at least one sharp bend therein between said valve member and the outlet of said chute, whereby straightline intrusion of forcing tools into said chute is impeded.

3. A security device as described in claim 1 wherein said actuating means comprises an electric heater element, a thermal-expansive element in heat-receiving relationship with said heater element, and a linkage connecting said thermo-expansive element with said valve means.

4. The security device of claim 1 wherein said actuating means is a solenoid.

* * * * *